US007811185B1

(12) United States Patent
Reynolds

(10) Patent No.: US 7,811,185 B1
(45) **Date of Patent: *Oct. 12, 2010**

(54) METHOD FOR TRAINING AND IMPROVEMENT OF BATTING SKILL

(75) Inventor: Paul Reynolds, Macon, GA (US)

(73) Assignee: Launch Pad 39A, LLC, Perry, GA (US)

( * ) Notice: Subject to any disclaimer, the term of this patent is extended or adjusted under 35 U.S.C. 154(b) by 41 days.

This patent is subject to a terminal disclaimer.

(21) Appl. No.: 12/048,210

(22) Filed: Mar. 13, 2008

Related U.S. Application Data

(60) Provisional application No. 61/034,948, filed on Mar. 7, 2008.

(51) Int. Cl.
*A63B 69/00* (2006.01)

(52) U.S. Cl. ..... 473/453; 473/207

(58) Field of Classification Search ..... 473/207, 473/213, 453, 458; 482/124
See application file for complete search history.

(56) References Cited

U.S. PATENT DOCUMENTS 3,680,869 A * 8/1972 Brady ..... 473/213
4,019,734 A 4/1977 Lee et al.
4,300,765 A 11/1981 Stringham
4,657,251 A 4/1987 Larsen
4,664,375 A 5/1987 Tetreault
4,681,318 A 7/1987 Lay
4,746,118 A 5/1988 Deveney
4,757,995 A 7/1988 Gallagher
4,826,165 A 5/1989 Socci
4,830,371 A 5/1989 Lay
4,867,448 A 9/1989 Judd
4,875,677 A 10/1989 Tetreault
5,037,094 A 8/1991 Johnson
5,106,085 A 4/1992 Lewy
5,114,142 A 5/1992 Gillespie
5,154,416 A 10/1992 Smull et al.
5,174,564 A 12/1992 Young, III
5,360,209 A 11/1994 Mollica
5,375,836 A 12/1994 Kiser
5,380,001 A 1/1995 Socci
5,428,846 A 7/1995 Socci
5,433,435 A 7/1995 Bourie
5,435,545 A 7/1995 Marotta
5,597,160 A 1/1997 Mims
5,601,286 A 2/1997 Fierbaugh
5,640,719 A 6/1997 Ritchie
5,704,856 A * 1/1998 Morse ..... 473/422

(Continued)

FOREIGN PATENT DOCUMENTS

JP 10043349 A 2/1998

(Continued)

*Primary Examiner*—Gene Kim
*Assistant Examiner*—M Chambers
(74) *Attorney, Agent, or Firm*—Brian D. Bellamy

(57) ABSTRACT

A method of training in swinging and hitting a baseball or softball in which a mechanical training aid is provided and attached to a batter's trailing back forearm and trailing back calf with a stretchable band attached between the back forearm and back calf. The band is stretched as a batter swings with proper extension and rotation of his body. The stretched band may further cause a visual, audible, or tactilely perceived indicator to the batter or observer that a batter has properly extended during a swing.

6 Claims, 5 Drawing Sheets

U.S. PATENT DOCUMENTS

| | | | | |
|---|---|---|---|---|
| 5,839,978 | A | 11/1998 | Evangelist | |
| 5,893,806 | A | 4/1999 | Martinez | |
| 5,938,548 | A | 8/1999 | Upshaw | |
| 5,954,598 | A | 9/1999 | Carlson | |
| 6,050,907 | A | 4/2000 | Long | |
| 6,231,464 | B1 | 5/2001 | Curtis | |
| 6,296,582 | B1 | 10/2001 | Minniear | |
| 6,375,581 | B1 | 4/2002 | Urban | |
| 6,413,176 | B1 | 7/2002 | Martinez | |
| 6,435,990 | B1 | 8/2002 | Bradley | |
| 6,514,161 | B1 | 2/2003 | Minniear | |
| 6,514,163 | B2 | 2/2003 | Burns | |
| D476,052 | S | 6/2003 | Barth | |
| 6,612,943 | B2 | 9/2003 | Beers | |
| 6,755,755 | B2 | 6/2004 | Wah Loh | |
| 6,773,366 | B2 | 8/2004 | Gray | |
| 6,918,844 | B2 * | 7/2005 | Socci | 473/458 |
| 6,923,737 | B1 | 8/2005 | Walker | |
| 6,932,724 | B2 | 8/2005 | Socci | |
| 6,984,184 | B2 | 1/2006 | Gray | |
| 7,172,522 | B1 * | 2/2007 | Harvey | 473/450 |
| 7,214,171 | B2 * | 5/2007 | Thelen et al. | 482/124 |
| 7,314,437 | B2 * | 1/2008 | Frappier | 482/124 |
| 2003/0178773 | A1 | 9/2003 | Meyer | |
| 2003/0224882 | A1 | 12/2003 | Mahoney | |
| 2004/0048696 | A1 | 3/2004 | Ciesar et al. | |
| 2004/0076939 | A1 | 4/2004 | Socci | |
| 2005/0043156 | A1 | 2/2005 | Wehrell | |
| 2009/0098945 | A1 * | 4/2009 | George | 473/213 |
| 2009/0227384 | A1 * | 9/2009 | Reynolds | 473/207 |

FOREIGN PATENT DOCUMENTS

| | | | |
|---|---|---|---|
| JP | 11099236 | A | 4/1999 |
| JP | 11309231 | A | 11/1999 |
| JP | 2000202082 | A | 7/2000 |
| JP | 2005246020 | A | 9/2005 |
| WO | 8501219 | A1 | 3/1985 |
| WO | 0238231 | A1 | 5/2002 |

* cited by examiner

Prior Art Fig. 1

METHOD FOR TRAINING AND IMPROVEMENT OF BATTING SKILL

PRIORITY CLAIM

The present non-provisional application claims benefit of U.S. provisional application No. 61/034,948 filed Mar. 7, 2008.

BACKGROUND OF THE INVENTION

1. Field of the Invention

The present invention relates to a method for training and improvement of swinging and batting skill and technique using a mechanical aid. More particularly, the invention pertains to a method for application of a mechanical aid to a person's body to teach the person to use proper rotation and extension of a baseball or softball bat or a golf club.

2. Discussion of the Prior Art

Batter's sometimes lack power and need further development of their swing. All young hitters would like to be able to hit home runs. Unfortunately though, many young hitters believe extension is achieved over the plate, rather than in front of the plate, resulting in a loss of power. To make matters worse, these same young hitters probably work with coaches and instructors who also do not understand that power is achieved by contact in front of the plate. Batters need a method using a mechanical training aid to assist in maintaining consistent form and gaining strength and improved mechanics A method using an aid is needed to teach young hitters in particular to feel the correct swing mechanism and understand and visualize correct swing mechanics.

There are two basic schools of thought when one discusses proper technique in hitting a baseball. One is known as rotational, the other as linear. There are many baseball training devices which propose to increase power. However, all of these devices relate to the linear school of hitting. Some of these aids are equipped to teach by strengthening the front arm, reducing the stride length, or both, rather than improving the strength and rotation of the backside. Ted Williams taught that the hips start the swing when hitting. After many years of trial and error, it has been shown that in fact the foot starts the swing because the foot starts the hip action taught by Ted Williams. Mr. Williams also taught that extension happens in front of the plate, rather than over the plate, with the elbow actually driving towards the pitch and initiating a point of contact in a positive power position.

Batters should extend the bat in front of the home plate, rather than over the plate and have back-side extension on the follow through. Proper extension increases distance and power when hitting. Therefore, a need exists for a method to teach extension, the use of the correct muscles when batting and to increase strength in the lower and upper backside of the batter.

U.S. Pat. No. 5,704,856, issued to Morse, discloses a device for training batters to properly shift weight to the back leg at the beginning of a swing and to shift weight to the front leg during a swing when striking the ball in baseball and similar games. The device includes a first strap for fastening to the leading leg just above the knee and a second strap for fastening to the leading wrist, "leading" being the side towards a pitcher. An elongated member connects the two straps and comprises an elastic portion and an adjustable length portion, which includes a separable buckle so that the elongated member can be separated without removing either strap. In use, straps are placed on the knee and wrist and the adjustable length portion is adjusted to be taut but not stretched with the batter in the "ready" position. At the start of a swing, the hands move back, stretching the elongated member to encourage weight movement to the back leg. When the forward swing and forward stride begin, the elongated member will be stretched forward to encourage weight shift to the forward leg. According to the theory taught by Morse, proper weight shift will provide maximum batting stroke power.

U.S. Pat. No. 5,938,548, issued to Upshaw, discloses a simplified training device for improving the batting skill of a batter in baseball, has a pair of arm cuffs adapted to encircle the arms of the batter at a location above the elbows thereof, and a pair of elongate flexible tie straps which are coextensive with each other and which extend between and are connected to the arm cuffs. The device is so constituted that the tie straps can be easily adjusted as to their effective lengths. When the tie straps are taut, they positively limit the maximum space between the arm cuffs at the time that the batter's arms are raised, retracted position. The straps are flexible and capable of collapsing movement to enable the arm cuffs to approach each other as the batter's arms are swung from the raised, retracted position toward the extended, ball-striking position.

U.S. Pat. No. 6,984,184 issued to Gray, disclosed an apparatus for building muscle memory to develop a more rapid baseball swing and avoid casting of the hands and bat during the swing. Such apparatus includes a first attachment member connectable to an upper arm and a second attachment member connectable to an opposing forearm interposed by an elongated tether to be aligned along a forearm upon initially entering into a hitter's stance. A method for using such apparatus is also disclosed.

While each of the above devices disclose resistance training aids, these aids do not teach a method to improve the skill of proper extension of a batter in front of the plate before striking a baseball. Previous aids are taught to attach to both arms of the user or to the front arm or front leg of the user. The attachment of mechanical aids to the front arm or front leg does not reinforce and teach proper forward extension and body rotation. Instead, the attachment of a mechanical aid to the front arm causes resistance and extension to be felt and observed during the take-back step of the swing and may assist with weight shift but not with teaching proper extension during rotation. The resistance of the aid when attached to the front arm or leg will collapse during the swing, thereby failing to train for power and reinforce the feeling of proper extension at the correct point of a swing.

Thus, a need exists for a method that a baseball player can use to teach himself or herself to have proper extension in front of a plate while batting and to have proper rotation. A further need exists for that same method to be used during warm-up and core strength training to continue reinforcement and improvement of the swings of baseball players. Yet a further need exists for a method that teaches proper rotation and extension to softball players.

SUMMARY OF THE INVENTION

The present invention solves these above problems and provides a method to use a mechanical training aid to teach baseball hitters how to achieve true extension at the plate. The invention also teaches softball players the same principle of extension at the plate, and can be used to teach golfers improved rotation and extension when swinging a golf club.

First, the method develops correct hitting fundamentals, developing upper and lower body strength and developing quickness to the point of contact with the backside of the hitters. Second, the method may include an additional step of providing an indicator of proper extension at the right time during the swing. Thereby, coaches are able to use the method of the invention to teach that arm extension and proper back rotation occurs before contact with the ball, rather than after. The training provided by the method results in improved skill and proper technique, which translates into better performance at the plate by the batter.

The method uses a mechanical aid that attaches to the user's body in accordance with the method taught by the invention. The mechanical aid includes two body attaching members that attach to a person's body in accordance with steps of the invention. The mechanical aid may include one or more tethers comprised of rigid members, flexible straps, tubing or stretchable bands that are attached between the body attaching members. In particular, the mechanical aid has a stretchable portion that allows for extension of the aid during body rotation and extension. The mechanical aid may further include an indicator of proper extension and rotation during a swing. The indicator may provide a signal by feel, sound, or vision. For example, a visual device may be intermediately positioned between the members that attach to the person's body. Such visual device may comprise resistance tubing and a separable cover about the resistance tubing in which abutting sleeves of the cover separate to expose a visual indicator of proper extension during a swing.

In the method for swinging or batting training, the mechanical aid is attached to specific locations on a person's body. In the steps provided to train in hitting and swinging, the mechanical aid is attached to the trailing back forearm of the batter, just below the person's elbow. The mechanical aid attaches to the trailing back calf of the person, just below the knee. The method provides for attachment of the mechanical aid to the back arm and back leg so that the aid will provide resistance training to the hitter to teach proper rotation and extension. The additional step of indicating proper extension can provide immediate feedback during practice of the method to a person training or a coach observing. In particular, the indicator provides confirmation that a batter has achieved true extension in front of the plate. As a result of the proper extension in front of the plate, the batter will experience increased power.

The method of training also provides for proper use of a training aid to provide useful resistance training during hitting and swinging that is beneficial for warm-up and strength improvement. Thus, the method is useful in teaching proper technique and extension, as well as warming up muscles and improving strength. Using a method that reinforces proper form and technique provides the best method for warming up in an on-deck type situation or in a strength training situation.

The method works well for fast-pitch and slow-pitch softball as well as baseball, and also golf. In golf, the method may be used with a training tee and as a warm-up method that improves confidence before approaching the first tee. In golf training, the method keeps the golfer's back elbow from lifting too far upward, which is undesirable in a proper golf swing. Further, the method can be used in resistance training to improve core strength in the golfer and improve balance. The method is particular useful for improving the swing of older golfers. Thus, the method may be adapted to several sports where extension and rotational core strength are important aspects of swing mechanics.

The method teaches proper swing mechanics and power by teaching and reinforcing proper extension through the improved use of a mechanical aid. In the method of this invention, a mechanical aid is attached to a person's body by attaching the aid to a person's back arm and back leg that are farthest away from a pitcher or target. The method provides resistance during forward extension and rotation of the body during a swing.

DETAILED DESCRIPTION OF THE INVENTION

Figure 1:
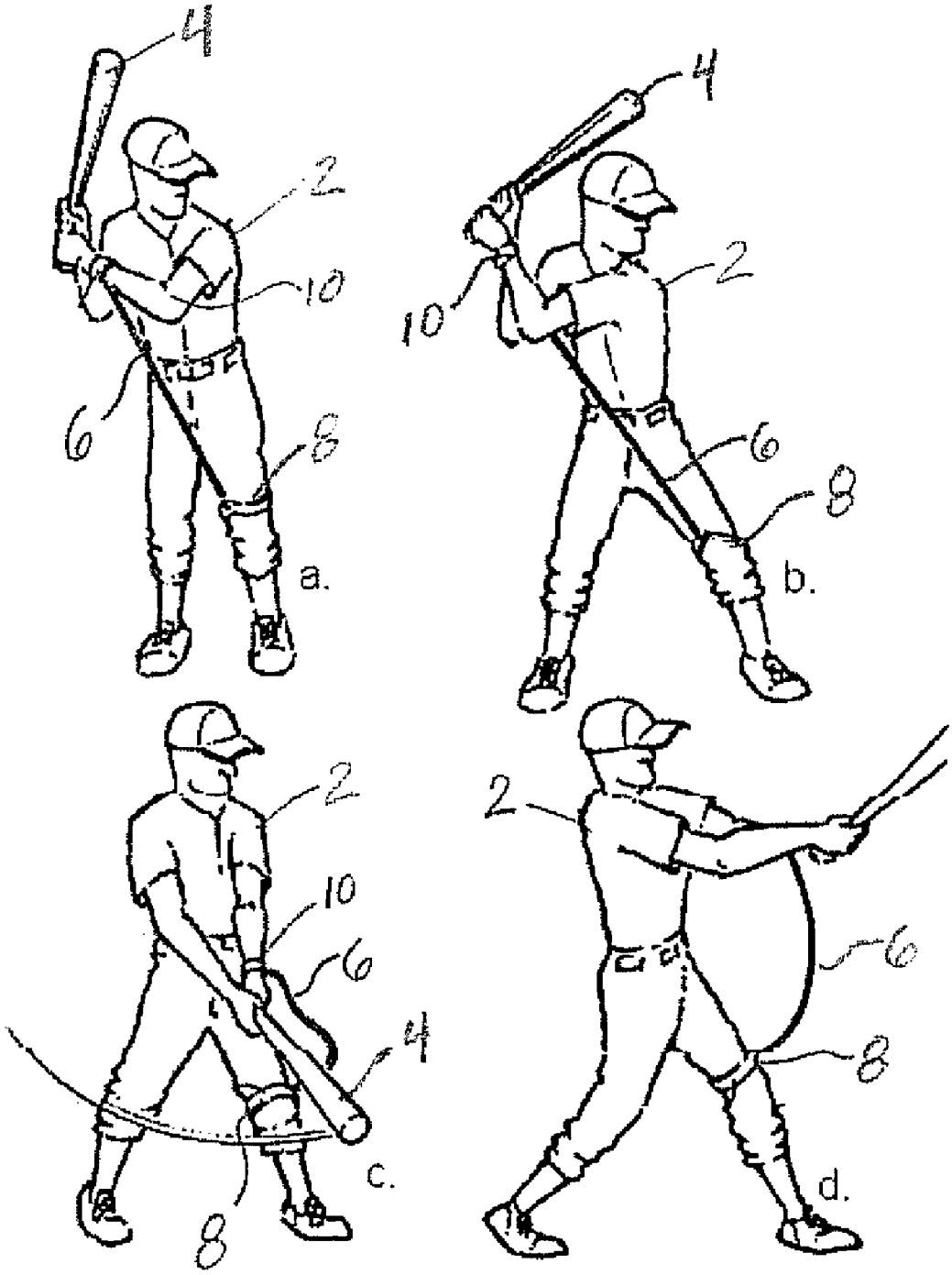
FIG. 1 *a-d* are perspective views illustrating a prior art method for training a person to swing a baseball bat.

Referring now to the drawings, FIG. 1 *a-d* show a batter 2 preparing to hit a ball with a bat 4 up in a ready position. The batter 2 in FIG. 1 *a-d* is wearing a prior art device used in the training of baseball players learning to hit a baseball or trying to increase their power. As seen in FIGS. 1*a-d*, the prior art device is attached to the batters front leg 8. For the purpose of the illustration herein, the batter is oriented facing a plate distally separated from a pitcher's mound. The front side of the batter 2 is considered the side of the batter that is closest to where a pitcher's mound would be located from which a pitcher throws a ball toward the batter. The back side of the batter 2 is considered the side of the batter farthest from the pitcher's mound. The prior art device shown in FIGS. 1*a-d* is also attached to the batters front arm 10. An elastic portion 6 connects between the front arm 10 and front leg 8. As the batter 2 prepares to swing the bat 4 by lifting the bat behind his head, the elastic portion 6 stretches and provides resistance to the batter 2 as shown in FIG. 1*a*. As the batter 2 steps forward with his front leg 8, the elastic portion 6 appears to stretch still further as shown in FIG. 1*b*. Then, as shown in FIG. 1*c*, the tension in the stretched elastic portion 6 begins to release and collapse as the batter 2 rotates and swings the bat forward toward an oncoming ball. The tension in the elastic portion 6 is completely released by the time the batter 2 makes contact with a ball. The batter is able to follow through on the swing without any further tension in the elastic portion as shown in FIG. 1*d*, and the elastic portion 6 does not stretch during rotation of the batter's body and extension of the bat 4 in front of the batter 2.

Figure 2:
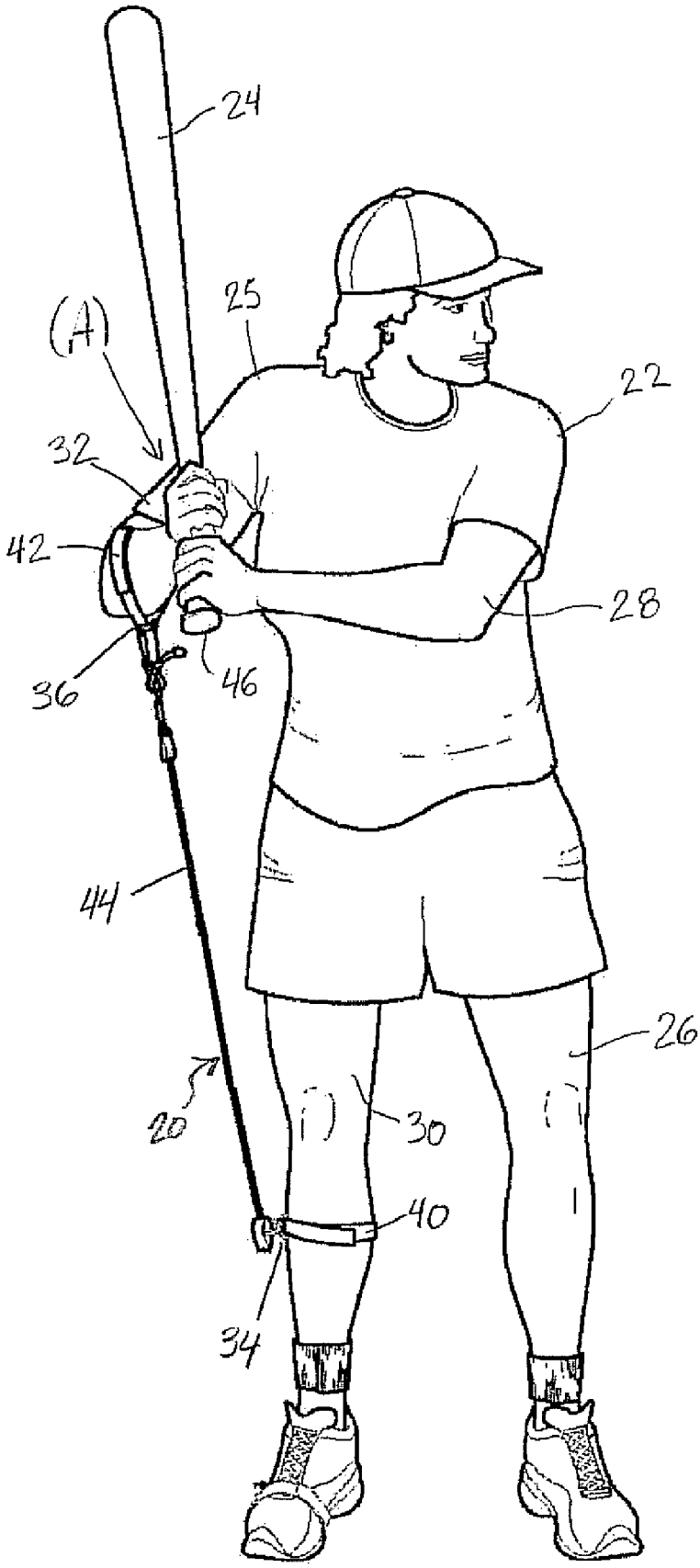
FIG. 2 is perspective view of a batter assuming an initial batter's stance while wearing a mechanical aid in accordance with the method of a preferred embodiment of the present invention and illustrating the attachment points of the mechanical aid with respect to the batter.

FIG. 2 shows an improved method for using a mechanical aid 20 to improve a batter's swing. FIG. 2 shows a batter 22 preparing to hit a ball with the bat 24 up over the batter's back shoulder 25 in an initial ready position (A) with the batter's body facing inward toward a plate for receiving a baseball or softball pitch. A front side of the batter 22 with front leg 26 and front arm 28 is directed outward toward a pitcher and is the side of the batter 22 that is turned closest to the pitcher's mound. A back side of the batter with back leg 30 and back arm 32 is situated pointing away from the pitcher toward the rear of a batter's box and turned farthest from the pitcher's mound. In the ready position, the training aid 20 is attached to the batter 22 using the present methodology in at least two locations on the back side of the batter.

In a first location, the training aid 20 is attached to the batter's trailing back leg calf at a first position 34, just below the batter's back knee. In a second location, the mechanical aid 20 is attached to the batter's trailing back forearm at a second position 36, just below the batter's back elbow where the forearm and elbow adjoin. The mechanical aid 20 is attached at each position using a length of fabric material, forming a first strap 40 that secures the aid about the back calf and a second strap 42 that secures the aid about the back forearm. The fabric material has ends with cooperating hook and loop material on opposite surfaces so that overlapping the ends to a predetermined degree and bringing the cooperating hook and loop material together will form a closed ring of predetermined circumference. The ring of fabric material is closed about each respective position on the batter's body to connect and secure the mechanical aid 20. The batter 22 can quickly remove the straps 40, 42 formed by the fabric material by detaching the cooperating hoop and loop surfaces, such that the aid 20 can be removed quickly enough to use while a batter is on deck preparing to bat.

The training aid 20 is provided a stretchable band 44 that is attached between the first attachment position 34 and the second attachment position 36 by connecting the stretchable band to each strap 40 and 42. The stretchable band 44 is connected to the strap 40 on the back leg 30 so that a first end of the stretchable band is situated on the back outside portion of the back calf to address a problem in which the band 44 can encroach and twist into the inside of the batter's leg improperly. The stretchable band 44 is connected to the strap 42 on the back arm 32 so that a second opposing end of the stretchable band is situated on the back forearm with the stretchable band extending downwards toward the batter's outside back calf.

Figure 3:
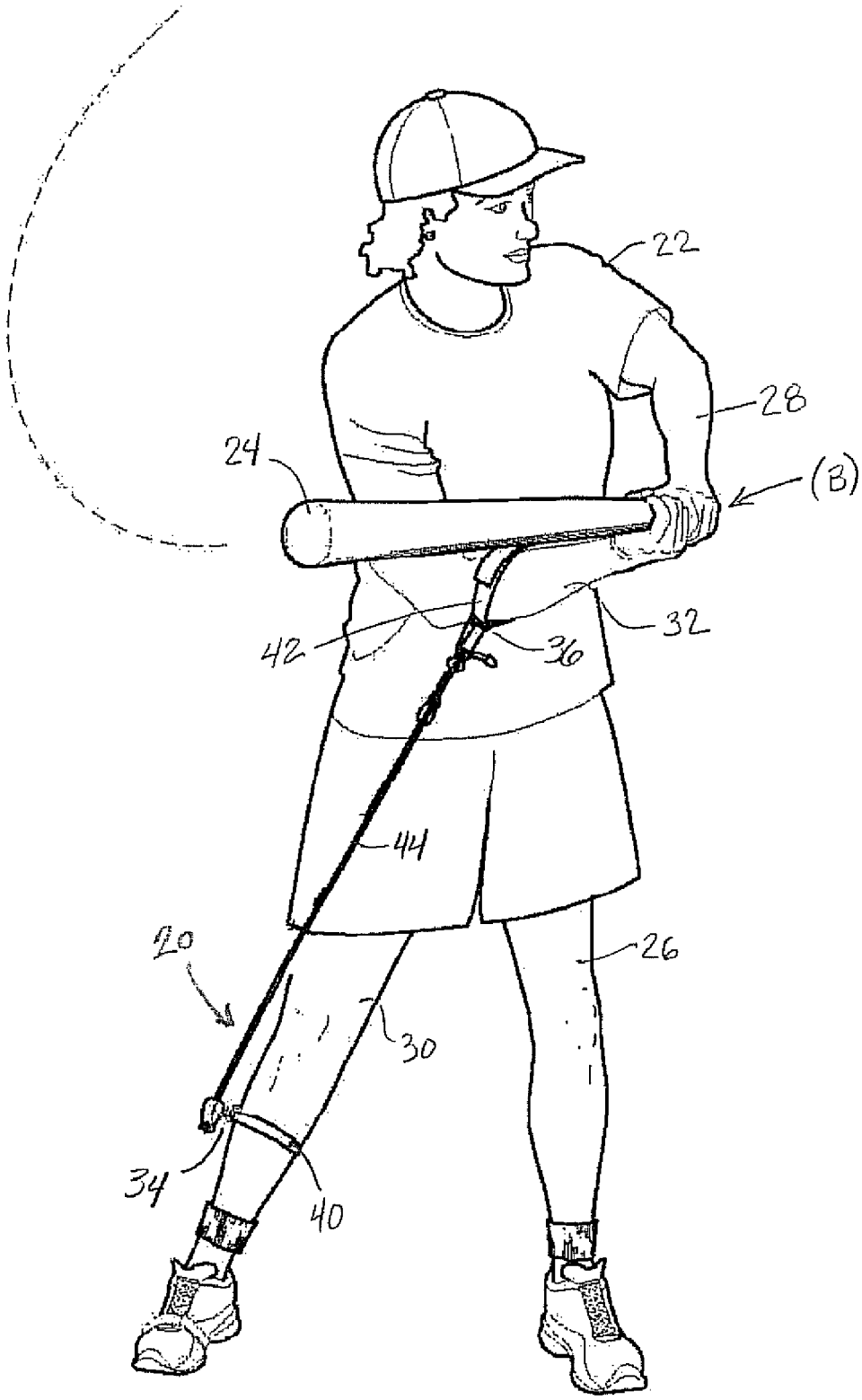
FIG. 3 is a perspective view of the batter shown in FIG. 2 prior to striking a ball.

While the stretchable band 44 may comprise any suitable elastic material, resistance tubing selected of predetermined desired resistance has been found to provide excellent performance. The band 44 stretches during a batter's swing by rotating the batter's body and extending the bat's handle 46 outward in front of the batter's body in accordance with the invention to provide muscle memory training and strength training Referring to FIG. 3, a batter 22 is shown half-way through her swing into a position (B) while extending the bat 24 out in front of the body through proper hip rotation initiated by the front foot. As the batter 22 extends the bat 24 out in front of his or her body, the distances between the batter's elbow, calf and foot lengthen. As a result, the stretchable band 44 extends, and as the band extends, the resistance of the band signals to the batter that she is making proper extension in front of the body and properly rotating the hips. With practice and growing strength, the batter 22 will be able to maximize extension and body rotation to improve hitting power and technique.

Figure 4:
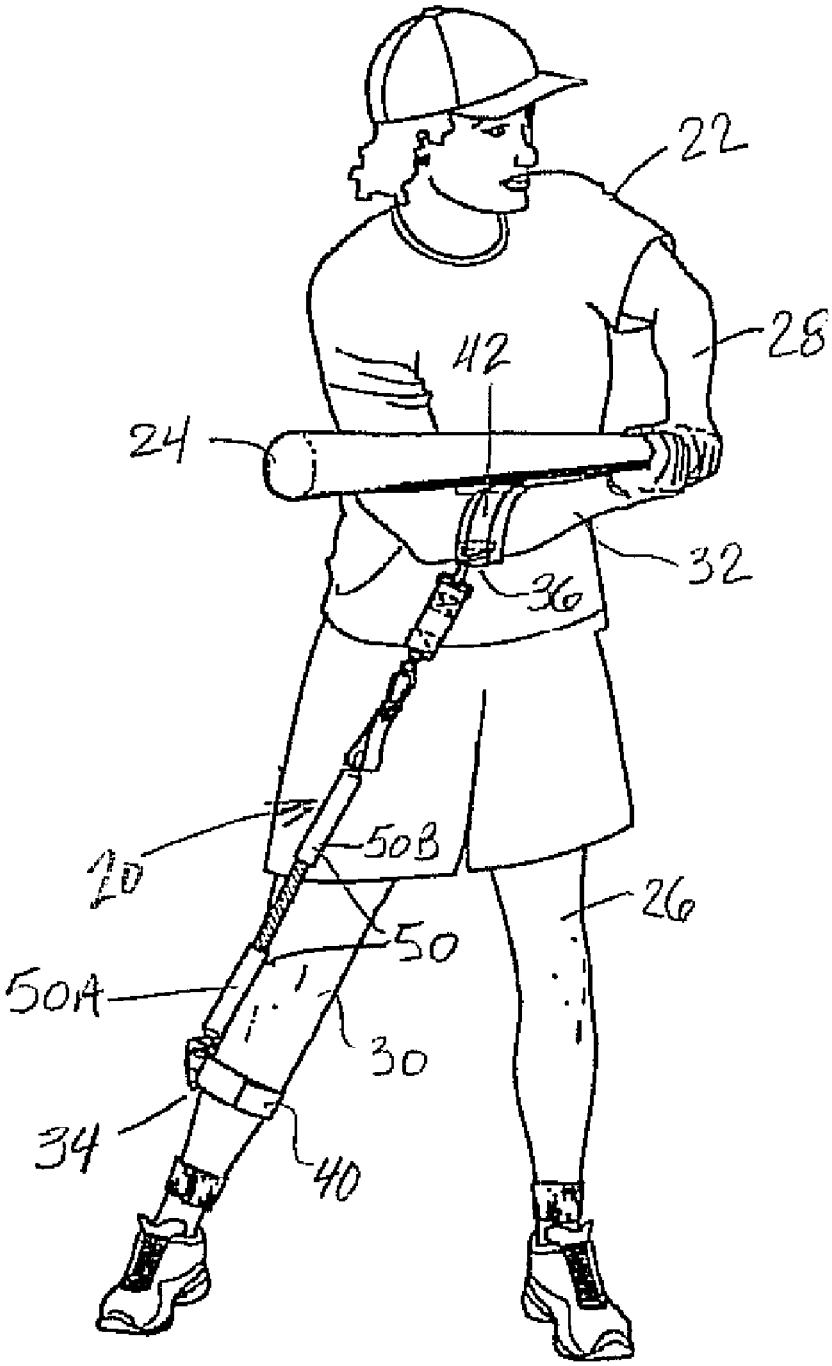
FIG. 4 is a perspective view of the batter shown in FIG. 3 showing a visual indicator of extension and rotation of the batter.
Figure 5:
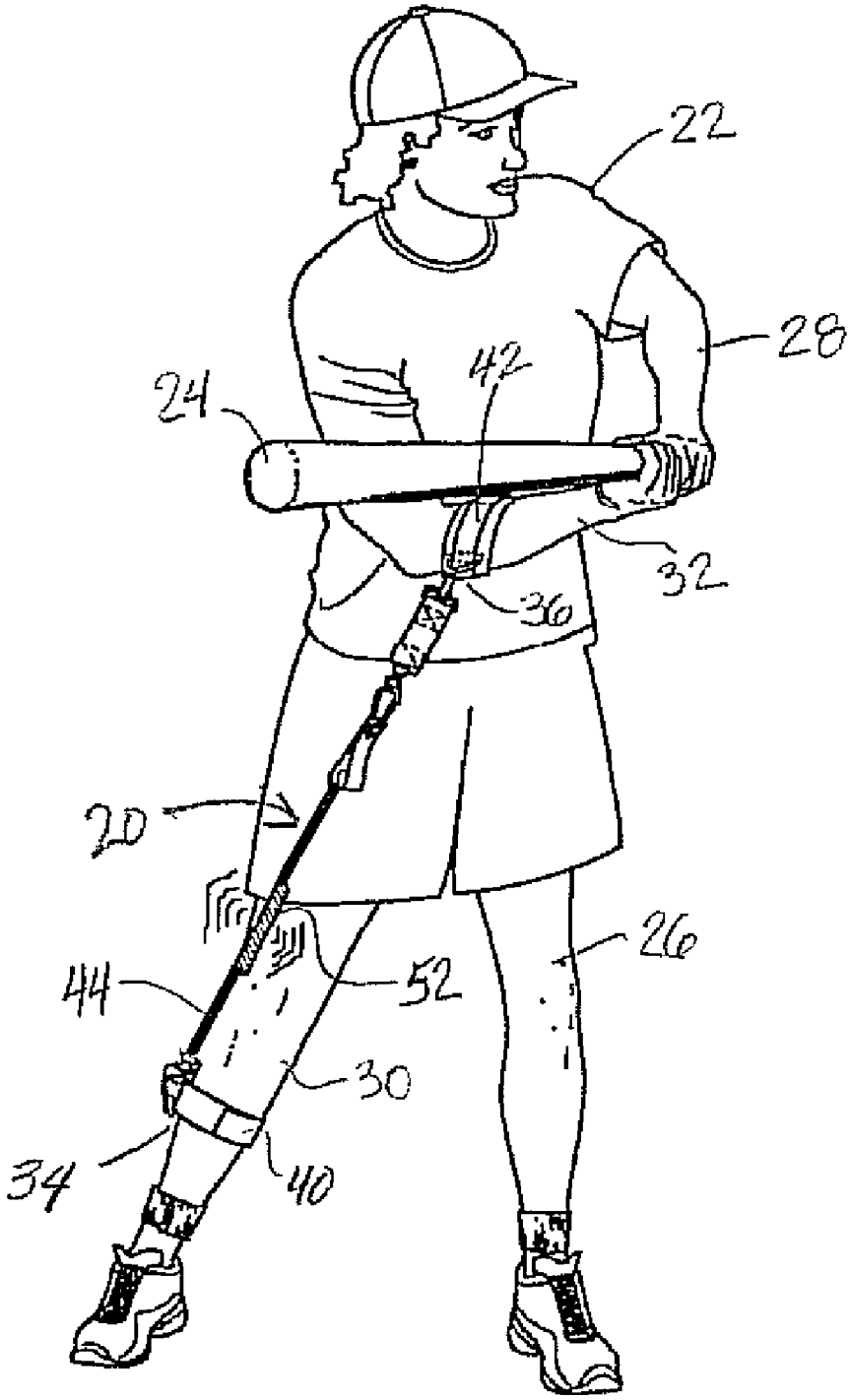
FIG. 5 is a perspective view of the batter shown in FIG. 3 showing an audible indicator of extension and rotation of the batter.

An indicator means may be provided to detect proper extension of the stretchable band 44. In particular the indicator means may include a visual signal such as a visible section of resistance tubing, an audible signal such as a sound produced by a device activated by extension of the stretchable band, or a tactilely perceived signal of proper extension. The indicator means may be provided by incorporating the indicator means onto the stretchable band 44 of the mechanical aid 20 between the foot and forearm attachment positions 34 and 36. In the case of a visual signal the indicator means will generally include the stretchable band 44 comprised of resistance tubing for indicating when the batter 22 is properly swinging with respect to extension in front of the batter's body.

Where the indicator means is a visual signal, an indicator section 48 of resistance tubing, which may comprise of the stretchable band 44, is provided that is comprised of a highly visible color such as red. As shown in FIG. 4, the indicator section is covered by a lightweight two-part sleeve 50. The sleeve 50 provides separable sleeve sections 50A-50B that split into two-parts at about the center of the sleeve and completely cover the indicator section 48 when the stretchable band 44 is not extended. The sleeve sections 50A-50B are attached at first and second opposing ends of the indicator section 48 of resistance tubing. When the stretchable band 44 is not properly extended as it should be during a correct swing, the sleeve 50 completely covers the indicator section 48. While the batter 22 is in the ready position shown in FIG. 2, the stretchable band 44 is not extended, and the indicator section 48 is not visible, thereby accurately showing that no extension is taking place. When the batter 22 swings and extends the bat 24 out in front of the batter's body as shown in FIG. 4, the stretchable band 44 is extended, and the indicator section 48 shows a portion of it's resistance tubing previously covered by the separable sleeve sections 50A-50B. The visible resistance tubing provides a visual signal that the batter 22 has properly rotated his or her hips and extended the bat 24 in front of the body during the swing. In another variation as shown in FIG. 5, a sound producing device 52 provides an audible signal that the batter 22 has swung properly when the stretchable band 44 is extended in front of the batter's body.

While the invention has been illustrated and described as embodied in a method of training in swinging and hitting, it is not intended to be limited to the details shown and discussed, since it will be understood that various omissions, modifications, substitutions and changes in the forms and details of the method illustrated and in its practice can be made by those skilled in the art without departing in any way from the spirit of the present invention.

I claim:

1. A method for training and improvement of batting skill comprising the steps of:

a. before swinging a bat, orienting a batter with his or her body in an initial position facing a plate distally separated from a pitcher's mound from which a pitcher throws a ball toward the batter, wherein the batter's front side is closest to the pitcher's mound and the batter's back side is farthest from the pitcher's mound and in which the batter's back side includes a trailing back arm, a trailing back leg, and a back shoulder over which the batter holds the bat in the initial position of the batter;

b. connecting a mechanical aid to the trailing back leg of the batter;

c. connecting the mechanical aid to the trailing back arm of the batter;

d. connecting a stretchable band of predetermined length between the trailing back leg of the batter and the trailing back arm of the batter;

e. displaying a visual indicator comprised of a easily visible portion of the stretchable band when the stretchable band is stretched and extended;

f. covering the stretchable band with a sleeve having two separable sections that separate to display the easily visible portion of the stretchable band when the stretchable band is stretched and extended; and g. stretching and extending the stretchable band by rotating the batter's body and extending the bat's handle outward in front of the batter's body.

2. A method for training and improvement of batting skill as in claim 1 in which:

the step of attaching the mechanical aid to the trailing back leg of the batter includes securing the aid by a first strap on the batter's back calf just below his or her back knee; and the step of attaching the mechanical aid to the trailing back arm of the batter includes securing the aid by a second strap to the batter's back forearm just below his or her back elbow.

3. A method for training and improvement of batting skill as in claim 2 in which the stretchable band is connected to the first strap at a first position on the batter's back side outside portion of his or her calf.

4. A method for training and improvement of batting skill as in claim 2 in which the stretchable band is connected to the second strap at a second position on the batter's forearm with the stretchable band extending downward toward the batter's calf from the second position.

5. A method for training and improvement of batting skill as in claim 1 including an additional step of providing an indicator means that produces an audible signal when the stretchable band is stretched and extended.

6. A method for training and improvement of batting skill as in claim 1 including a step of producing a tactilely perceived signal when the stretchable band is stretched and extended.

* * * * *